US006955527B2

(12) United States Patent
Yen

(10) Patent No.: US 6,955,527 B2
(45) Date of Patent: Oct. 18, 2005

(54) TWO-WAY MOUNTING AIR PUMP WITH AN INFLATION MODE AND A DEFLATION MODE

(76) Inventor: Stanley Yen, 3F, No. 44-2, Lane 260, Kwang Fu South Road, Taipei (TW)

( * ) Notice: Subject to any disclaimer, the term of this patent is extended or adjusted under 35 U.S.C. 154(b) by 204 days.

(21) Appl. No.: 10/447,694

(22) Filed: May 29, 2003

(65) Prior Publication Data

US 2004/0241014 A1 Dec. 2, 2004

(51) Int. Cl.[7] ..... F04B 35/04

(52) U.S. Cl. ..... 417/360; 417/411; 417/423.14; 417/423.15; 439/929; 5/706; 5/713; 5/935

(58) Field of Search ..... 417/360, 423.1, 417/423.14, 423.15, 411; 5/413 AM, 655.3, 706, 708, 713, 935; 439/374, 929

(56) References Cited

U.S. PATENT DOCUMENTS 2,825,799 A * 3/1958 Julien ..... 362/549
3,045,900 A * 7/1962 Zekendorf ..... 150/106
4,431,245 A * 2/1984 Jigamian et al. ..... 439/344
4,466,780 A * 8/1984 Naurath ..... 417/360
4,661,048 A * 4/1987 Masaka et al. ..... 417/360
5,003,330 A * 3/1991 Kotani et al. ..... 396/176
5,152,579 A * 10/1992 Bishai ..... 297/284.6
5,468,124 A * 11/1995 Chen ..... 416/63
6,193,478 B1 * 2/2001 Lin et al. ..... 417/423.15
6,543,073 B2 * 4/2003 Wu ..... 5/713
6,733,254 B1 * 5/2004 Yen ..... 417/423.1
6,793,469 B2 * 9/2004 Chung ..... 417/411
2002/0194678 A1 * 12/2002 Chung ..... 5/713

* cited by examiner

*Primary Examiner*—Timothy S. Thorpe
*Assistant Examiner*—Emmanuel Sayoc
(74) *Attorney, Agent, or Firm*—Pai Patent & Trademark Law Firm; Chao-Chang David Pai

(57) ABSTRACT

A two-way mounting mode air pump is constructed to include a housing affixed to an inflatable object, a battery case mounted in the housing, the battery case having a female coupling device and power output contacts in the female coupling device, and a motor pump selectively mounted in the housing in either of two directions to selectively pump air into or out of the inflatable object, the motor pump having a male coupling device for coupling to the female coupling device and power input contacts in the male coupling device for contacting the power output contacts.

4 Claims, 5 Drawing Sheets

TWO-WAY MOUNTING AIR PUMP WITH AN INFLATION MODE AND A DEFLATION MODE

BACKGROUND OF THE INVENTION

1. Field of the Invention

The present invention relates to air pumps and, more particularly, to a two-way mounting mode air pump, which can be selectively arranged in either of two positions to pump air into or out of an inflatable object.

2. Description of the Related Art

When inflating or deflating a big inflatable object, for example, an air mattress, air pump means may be used. There are inflatable mattresses with affixed air pump means. FIG. 1 illustrates a similar prior art design. As illustrated, a mount 7 is affixed to the wall panel of the air mattress (not shown). The mount 7 has a fixed battery case 72, a mounting hole 71, and power output contacts 73 disposed in the mounting hole 71 for output of power from the battery set in the battery case 72. A motor pump 8 is insertable in the mounting hole 71. The motor pump 8 has an air inlet 82 in one end, and air outlet 83 in the other end, and power input contacts 81 at the periphery. The motor pump 8 can be inserted into the mounting hole 71 in a first position to pump outside air into the air mattress, or in a second position to pump inside air out of the air mattress. To use it, the user needs to rotate the motor pump 8 in the mounting hole 71 to move the power input contacts 81 into contact with the power output contacts 73 respectively. After each use, the user needs to rotate the motor pump 8 again to disconnect the power input contacts 81 from the power output contacts 73. This operating procedure is complicated. When rotating the motor pump 8, it is difficult to control the accurate angle of rotation. If the motor pump 8 is not accurately rotated into position, battery power supply cannot be transmitted to the motor pump 8. Positioning means may be provided to ensure accurate positioning of the motor pump 8 in the mounting hole 71. However, the installation of such positioning means greatly increases the cost. Further, because the battery case 72 is fixedly installed in the mount 7, it cannot be detached from the mount 7 for use with the motor pump 8 in other places.

BRIEF SUMMARY OF THE INVENTION

The present invention has been accomplished under the circumstances in view. It is the main object of the present invention to provide a two-way mounting mode air pump, which is detachable, easy to operate, and can be selectively mounted in either of two positions to pump air into or out of an inflatable object.

To achieve this and other objects of the present invention, the two-way mounting mode air pump comprises a housing affixed to an inflatable object; a battery case mounted in the housing, the battery case comprising a case body holding a battery set, a coupling device longitudinally extended in the periphery of the case body, a case cover hinged to the case body, a set of power output contacts disposed in the coupling device at the case body and electrically connected to the battery set, and switch means mounted in the case cover and electrically connected between the battery set and the power output contacts; and a motor pump mounted in the housing, the motor pump comprising an air inlet in one end thereof, an air outlet in an opposite end thereof, a coupling device in the periphery thereof for coupling to the coupling device of the battery case, and a plurality of power input contacts respectively disposed in the coupling device of the motor pump and adapted to contact the power output contacts of the battery case upon connection of the coupling device of the motor pump to the coupling device of the battery case. The motor pump can be mounted in the housing either in a first position, where the motor pump pumps air from the atmosphere into the inflatable object to which the two-way mounting mode air pump is installed, or in a second position where the motor pump pumps air out of the inflatable object to the atmosphere.

DETAILED DESCRIPTION OF THE PREFERRED EMBODIMENT

Figure 1:
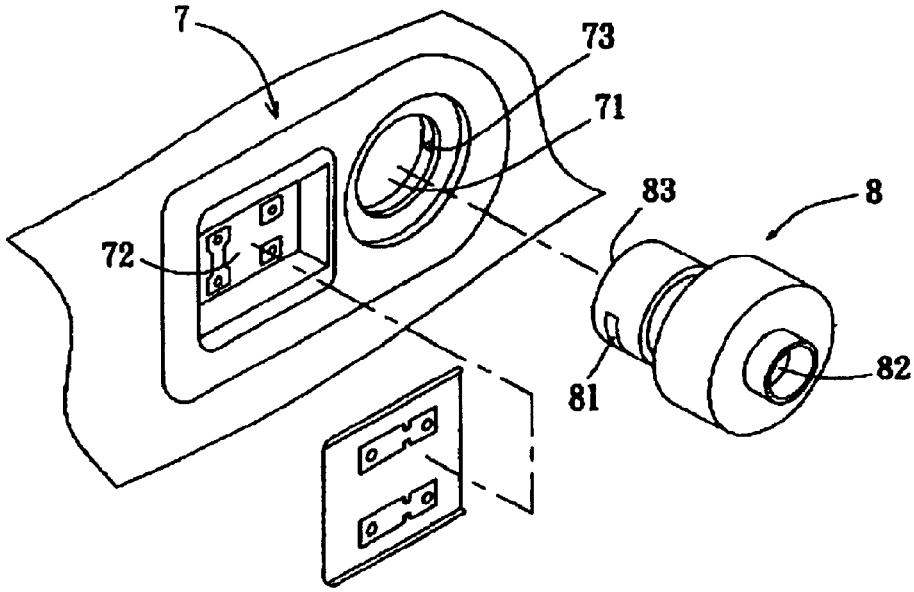
FIG. 1 (PRIOR ART)
FIG. 1 is an exploded view of the prior art design.
Figure 2:
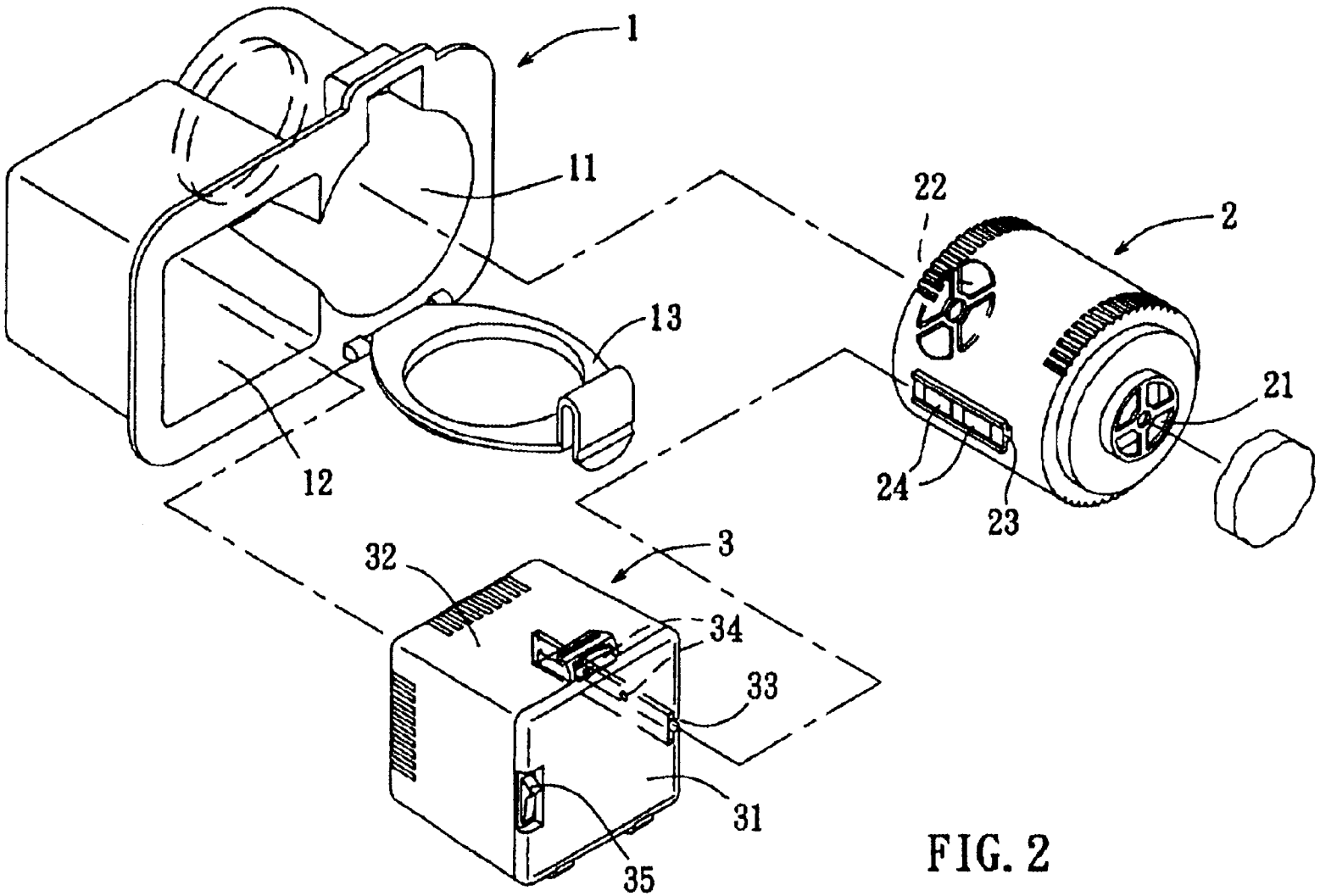
FIG. 2 is an exploded view of a two-way mounting mode air pump according to the present invention.
Figure 3:
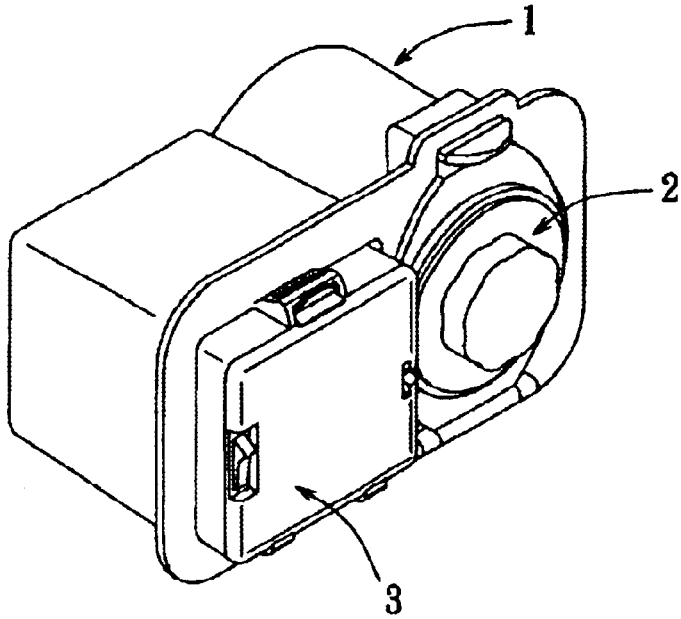
FIG. 3 is an assembly view of the two-way mounting mode air pump according to the present invention.

Referring to FIGS. 2 and 3, a two-way mounting mode air pump in accordance with the present invention is designed for use for an inflatable object, for example, an air mattress, comprising a housing 1, a motor pump 2, and a battery case 3.

The housing 1 is injection-molded from plastics, and fixedly bonded or heat-sealed to the inflatable object at one side, having a first receiving chamber 11, a second receiving chamber 12, and a hinged cap 13 adapted to hold the motor pump 2 in the first receiving chamber 11. The first receiving chamber 11 and the second receiving chamber 12 are peripherally in communication with each other. The first receiving chamber 11 is a cylindrical, double open-end chamber fitting the motor pump 2. The second receiving chamber 12 is a rectangular chamber fitting the battery case 3.

The motor pump 2 is mounted in the first receiving chamber 11 of the housing 1, comprising an air inlet 21 and an air outlet 22 respectively disposed in the two distal ends, a longitudinal male coupling device 23 protruded from the periphery, and a set of power input contacts 24 formed in the male coupling device 23 and electrically connected to the inside motor (not shown). The male coupling device 23 is shaped like a T-bar.

The battery case 3 is mounted in the second receiving chamber 12 of the housing 1, comprising a case body 32, a case cover 31 adapted to close the case body 32, and a set of battery cells (not shown) mounted in the case body 32. The case body 32 comprises a female coupling device 33, for example, a coupling groove of T-shaped cross section, adapted to receive the male coupling device 23 of the motor pump 2, and a set of power output contacts 34 formed in the female coupling device 33 corresponding to the power input contacts 24 of the motor pump 2. The case cover 31 is hinged to the case body 32, having a switch 35 mounted thereon and electrically connected to the set of battery cells inside the case body 32.

When in use, the motor pump 2 and the battery case 3 are respectively inserted into the first receiving chamber 11 and second receiving chamber 12 of the housing 1 to force the male coupling device 23 into engagement with the female coupling device 33. When installed, the power input contacts 24 of the motor pump 2 are respectively maintained in contact with the power output contacts 34 of the battery case 3. Therefore, the user can control the switch 35 to turn on/off the motor pump 2.

Figure 4:
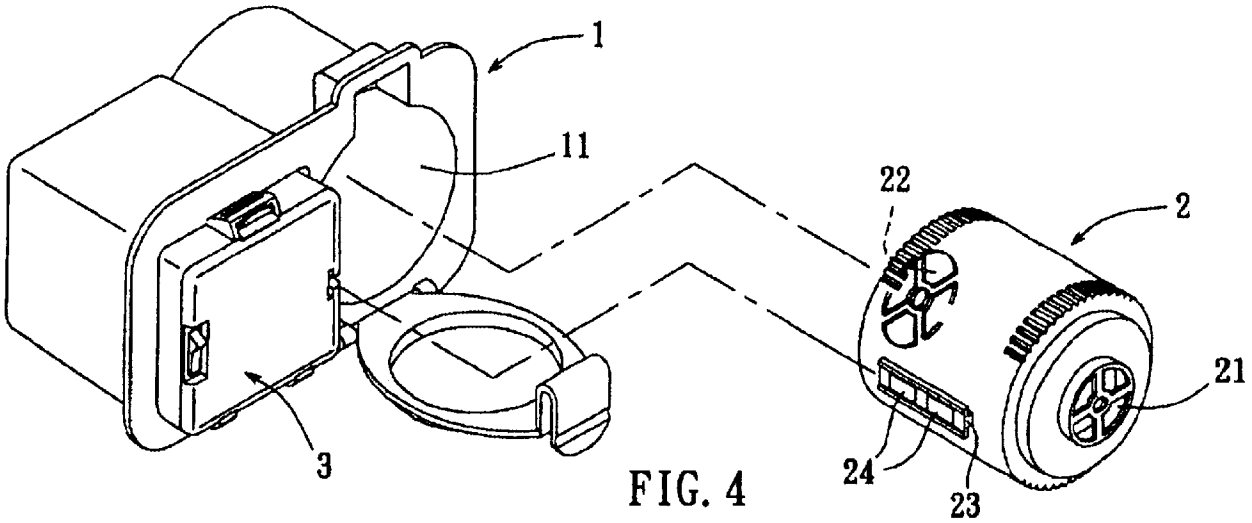
FIG. 4 illustrates the first installation mode of the two-way mounting mode air pump according to the present invention.
Figure 5:
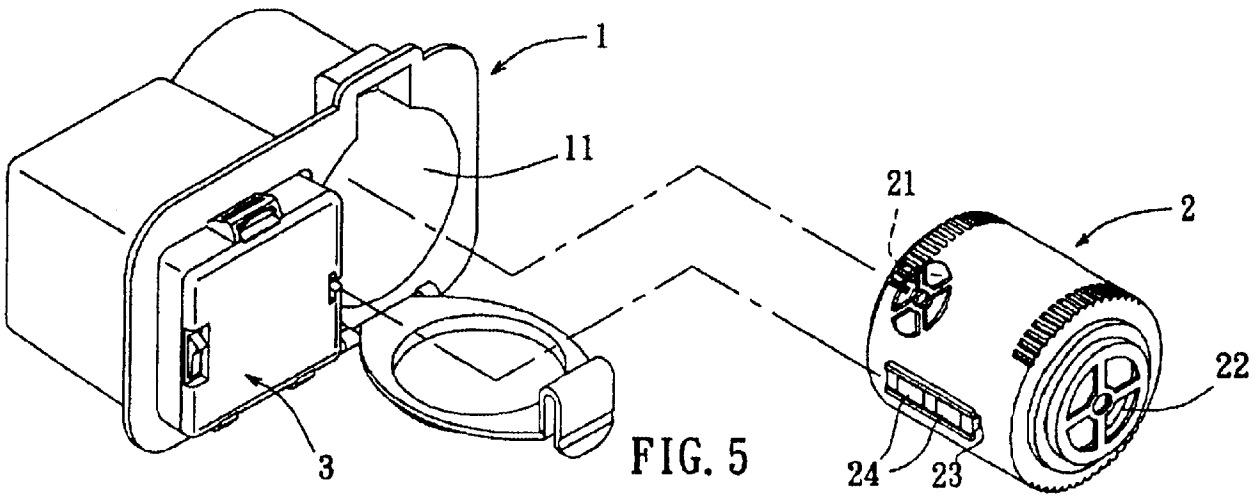
FIG. 5 illustrates the second installation mode of the two-way mounting mode air pump according to the present invention.

Referring to FIGS. 4 and 5, the motor pump 2 can be installed in the first receiving chamber 11 of the housing 1 in either of two reverse directions. When the motor pump 2 is installed in the first receiving chamber 11 of the housing 1 in the first direction (see FIG. 4), the air inlet 21 is disposed in the front side of the housing 1 and the air outlet 22 is disposed in the back side of the housing 1. In this case, the motor pump 2 pumps outside air from the atmosphere into the inside of the inflatable object (not shown) to which the two-way mounting mode air pump is installed. On the contrary, when the motor pump 2 is installed in the first receiving chamber 11 of the housing 1 in the second direction (see FIG. 5), the air inlet 21 is disposed in the back side of the housing 1 and the air outlet 22 is disposed in the front side of the housing 1. In this case, the motor pump 2 pumps inside air out of the inflatable object to the atmosphere. When the motor pump 2 is inserted into the first receiving chamber 11 of the housing 1 to force the male coupling device 23 into engagement with the female coupling device 33 of the battery case 3, the power input contacts 24 are automatically set into contact with the power output contacts 34 of the battery case 3. When the switch 35 is turned on, the motor pump 2 is started to pump air into or out of the inflatable object.

Figure 6:
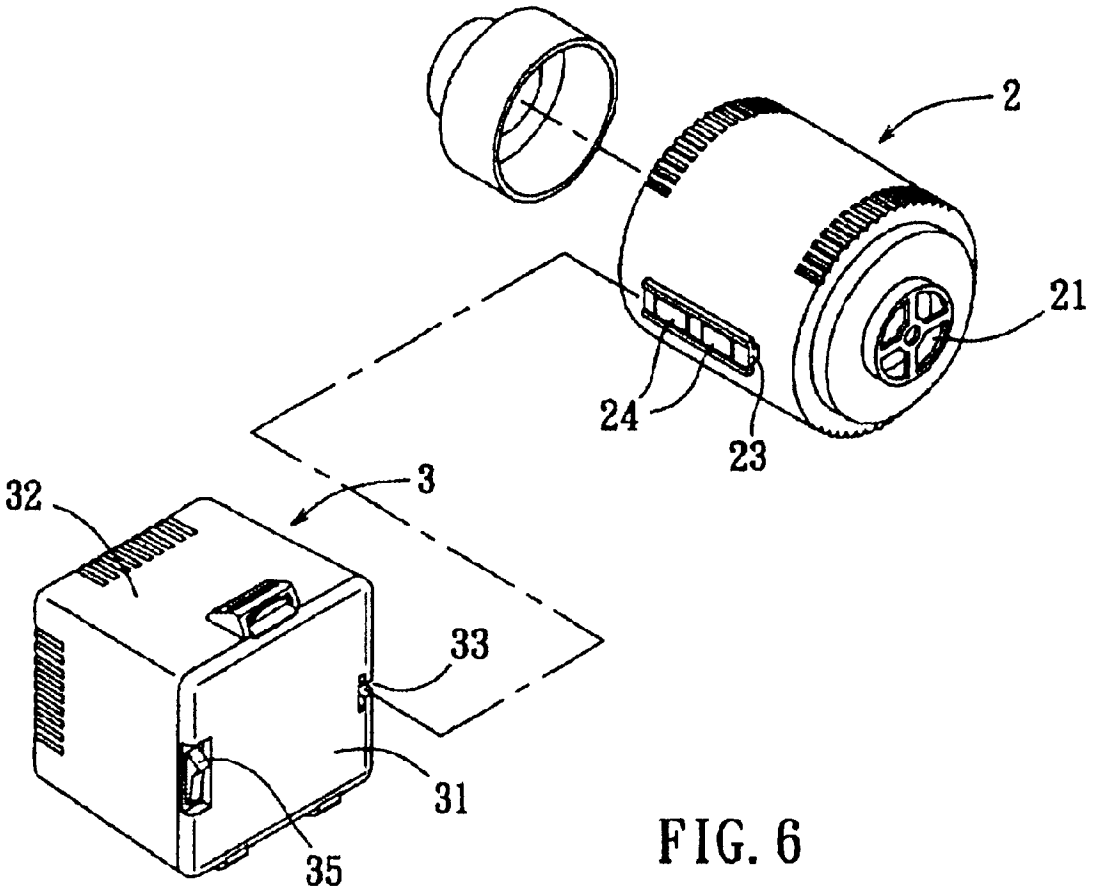
FIG. 6 is an exploded view showing the use of the motor pump with the battery case according to the present invention.

Referring to FIG. 6, the motor pump 2 can be used with the battery case 3 without the housing 1. When the motor pump 2 is attached to the battery case 3 in either of the aforesaid two directions, the assembly of the motor pump 2 and the battery case 3 can be carried by the user to any working place.

Although a particular embodiment of the invention has been described in detail for purposes of illustration, various modifications and enhancements may be made without departing from the spirit and scope of the invention. Accordingly, the invention is not to be limited except as by the appended claims.

The invention claimed is:

1. A two-way mounting mode air pump comprising:

a housing affixed to an inflatable object;

a battery case mounted in said housing, said battery case comprising a case body holding a battery set, a coupling device longitudinally extended in the periphery of said case body, a case cover hinged to said case body, a set of power output contacts disposed in the coupling device at said case body and electrically connected to said battery set, and switch means mounted in said case cover and electrically connected between said battery set and said power output contacts; and a motor pump selectively mounted in said housing in a first position to pump air from the atmosphere to the inside of the inflatable object or in a second position to pump air out of the inflatable object to the atmosphere, said motor pump comprising an air inlet in one end of the motor pump, an air outlet on an opposite end of the motor pump, a coupling device at the periphery of the motor pump for coupling to the coupling device of said battery case, and a plurality of power input contacts respectively disposed in the coupling device of said motor pump and adapted to contact said power output contacts of said battery case upon connection of the coupling device of said motor pump to the coupling device of said battery case.

2. The two-way mounting mode air pump as claimed in claim 1, wherein the coupling device of said motor pump is a coupling bar of T-shaped cross section, and the coupling device of said battery case is a coupling groove of T-shaped cross section fitting said coupling bar of T-shaped cross section.

3. The two-way mounting mode air pump as claimed in claim 1, wherein said housing comprises first receiving chamber adapted to receive said motor pump, and a second receiving chamber in communication with said first receiving chamber and adapted to receive said battery case.

4. The two-way mounting mode air pump as claimed in claim 3, wherein said housing comprises a hinged cap adapted to hold down said motor pump in said first receiving chamber.

* * * * *